US011225986B2

(12) United States Patent
Chen

(10) Patent No.: US 11,225,986 B2
(45) Date of Patent: Jan. 18, 2022

(54) PNEUMATIC CONTROL DEVICE

(71) Applicant: Hold Well Industrial Co., Ltd., Taichung (TW)

(72) Inventor: Wen-Pin Chen, Taichung (TW)

(73) Assignee: Hold Well Industrial Co., Ltd., Taichung (TW)

( * ) Notice: Subject to any disclaimer, the term of this patent is extended or adjusted under 35 U.S.C. 154(b) by 204 days.

(21) Appl. No.: 16/800,660

(22) Filed: Feb. 25, 2020

(65) Prior Publication Data

US 2020/0271144 A1 Aug. 27, 2020

(30) Foreign Application Priority Data

Feb. 27, 2019 (TW) ..... 108106861

(51) Int. Cl.

| | |
|---|---|
| ***F15B 21/10*** | (2006.01) |
| ***F15B 13/04*** | (2006.01) |
| ***F01C 21/18*** | (2006.01) |
| ***F01C 1/344*** | (2006.01) |
| ***B25B 21/00*** | (2006.01) |
| ***B25B 23/145*** | (2006.01) |

(52) U.S. Cl.

CPC ..... *F15B 21/10* (2013.01); *B25B 21/005* (2013.01); *B25B 23/1453* (2013.01); *F01C 1/3442* (2013.01); *F01C 21/18* (2013.01); *F15B 13/0401* (2013.01)

(58) Field of Classification Search

CPC ..... F01C 20/06; F01C 21/18; F01C 1/3442; F15B 21/10; F15B 13/0401; B25B 21/005; B25B 23/145; B25B 23/1453

USPC ..... 251/48

See application file for complete search history.

(56) References Cited

U.S. PATENT DOCUMENTS 3,033,236 A * 5/1962 Rayman ..... F16K 31/363 137/624.15
3,318,391 A * 5/1967 Linsker ..... B23Q 5/265 173/19
3,419,113 A * 12/1968 Shelley ..... F15B 21/10 188/280
3,590,582 A * 7/1971 German ..... B25B 23/145 60/394
3,608,647 A * 9/1971 Borries ..... B25B 23/145 173/177
3,732,934 A * 5/1973 Brandenberg ..... B25B 23/1453 173/177

(Continued)

FOREIGN PATENT DOCUMENTS

TW I259865 B 8/2006
TW 201440965 A 11/2014

*Primary Examiner* — William M McCalister
(74) *Attorney, Agent, or Firm* — TraskBritt

(57) ABSTRACT

A pneumatic control device includes a base seat unit, a cylinder unit and a time-delay unit. The cylinder unit is mounted the base seat unit, and is able to drive rotational movement. The time-delay unit is mounted to the base seat unit, and includes sequentially interconnected delay switch, flow-limiting valve, pressure accumulator and a control valve. The delay switch is operable to move between an action position whereat the cylinder unit drives the rotational movement, and a non-action position. When the delay switch is moved to the non-action position, the cylinder unit keeps driving the rotational movement for a period of time and then stops.

7 Claims, 21 Drawing Sheets

(56) References Cited

U.S. PATENT DOCUMENTS

| | | | | | |
|---|---|---|---|---|---|
| 3,821,991 | A * | 7/1974 | Alexander | B25B 23/1456 | 173/180 |
| 3,904,305 | A * | 9/1975 | Boyd | F01B 25/16 | 415/25 |
| 5,465,746 | A * | 11/1995 | Ebbing | F15B 21/10 | 137/102 |
| 5,855,114 | A * | 1/1999 | Runesson | F15B 21/10 | 60/413 |
| 6,523,621 | B1 * | 2/2003 | Gosis | B25C 1/008 | 173/206 |
| 2004/0089829 | A1 * | 5/2004 | Ludwig | F01L 9/10 | 251/48 |
| 2016/0168822 | A1 * | 6/2016 | White | F15B 1/04 | 60/413 |
| 2017/0015534 | A1 * | 1/2017 | Benton | B66C 23/36 | |

* cited by examiner (b)

(a)

PNEUMATIC CONTROL DEVICE

CROSS-REFERENCE TO RELATED APPLICATION

This application claims the benefit of the priority date of Taiwanese Invention Patent Application No. 108106861, filed on Feb. 27, 2019, the disclosure of which is incorporated herein in its entirety by this reference.

FIELD

The disclosure relates to an actuator, and more particularly to a pneumatic control device.

BACKGROUND

A conventional pneumatic tool disclosed in Taiwanese Invention Patent No. I259865 utilizes pressured air to drive rotation of an output shaft thereof. However, such conventional pneumatic tool does not have a time-delay valve module. Another conventional pneumatic tool disclosed in Taiwanese Patent Publication No. 201440965 does not have a time-delay valve module as well.

SUMMARY

Therefore, an object of the disclosure is to provide a pneumatic control device that can alleviate the drawback of the prior art.

According to the disclosure, the pneumatic control device is adapted to be fluidly connected to a pneumatic supplier, and includes a base seat unit, a first rotation control unit, a second rotation control unit, a cylinder unit, an output unit and a time-delay unit. The base seat unit has an axial hole that extends along an axial line, an intake channel that is adapted to be fluidly connected to the pneumatic supplier, a first retaining space that is fluidly connected to the intake channel, a second retaining space that is fluidly connected to the intake channel, a first guide channel that fluidly communicates the first retaining space with the axial hole, a second guide channel that fluidly communicates the second retaining space with the axial hole, and a vent hole that fluidly communicates the axial hole with external environment. The first rotation control unit is installed in the first retaining space, and is operable to move between at an action position whereat fluid communication between the intake channel and the first guide channel is permitted, and a non-action position whereat the fluid communication between the intake channel and the first guide channel is prevented. The second rotation control unit is installed in the second retaining space, and is operable to move between an action position whereat fluid communication between the intake channel and the second guide channel is permitted, and a non-action position whereat the fluid communication between the intake channel and the second guide channel is prevented. The cylinder unit is installed in the axial hole of the base seat unit, and is able to drive a first rotational movement about the axial line upon receipt of fluid from the first guide channel and to drive a second rotational movement opposite to the first rotational movement upon receipt of fluid from the second guide channel. The output unit is installed in the axial hole of the base seat unit, and is connected to an end of the cylinder unit along the axial line for outputting the rotation generated by the cylinder unit. The time-delay unit is mounted to the base seat unit, and includes a delay switch that is adapted to be fluidly connected to the pneumatic supplier, a flow-limiting valve that is connected downstream of the delay switch, a pressure accumulator that is connected downstream of the flow-limiting valve, and a control valve that is connected downstream of the pressure accumulator and that is fluidly connected to the first retaining space and the pneumatic supplier. The delay switch is operable to move between an action position and a non-action position. when the delay switch is at the action position, the control valve permits fluid communication between the pneumatic supplier and the first retaining space therethrough. When the delay switch is moved to the non-action position, the control valve maintains the fluid communication between the pneumatic supplier and the first retaining space for a period of time and then prevents the fluid communication between the pneumatic supplier and the first retaining space.

BRIEF DESCRIPTION OF THE DRAWINGS

Other features and advantages of the disclosure will become apparent in the following detailed description of the embodiment with reference to the accompanying drawings, of which:

FIGS. 9 to 14 are schematic views illustrating airflow within the embodiment when a cylinder unit of the embodiment drives a first rotational movement, wherein FIG. 9 is a sectional view taken along line IX-IX in FIG. 7, FIG. 10 is a sectional view taken along line X-X in FIG. 8, FIG. 11 is a sectional view taken along line XI-XI in FIG. 10, and FIG. 12 is a sectional view taken along line XII-XII in FIG. 10;

FIGS. 15 to 17 are schematic views illustrating airflow within the embodiment when the cylinder unit of the embodiment drives a second rotational movement, wherein FIG. 17 is a sectional view taken along line XVII-XVII in FIG. 16;

Figure 18:
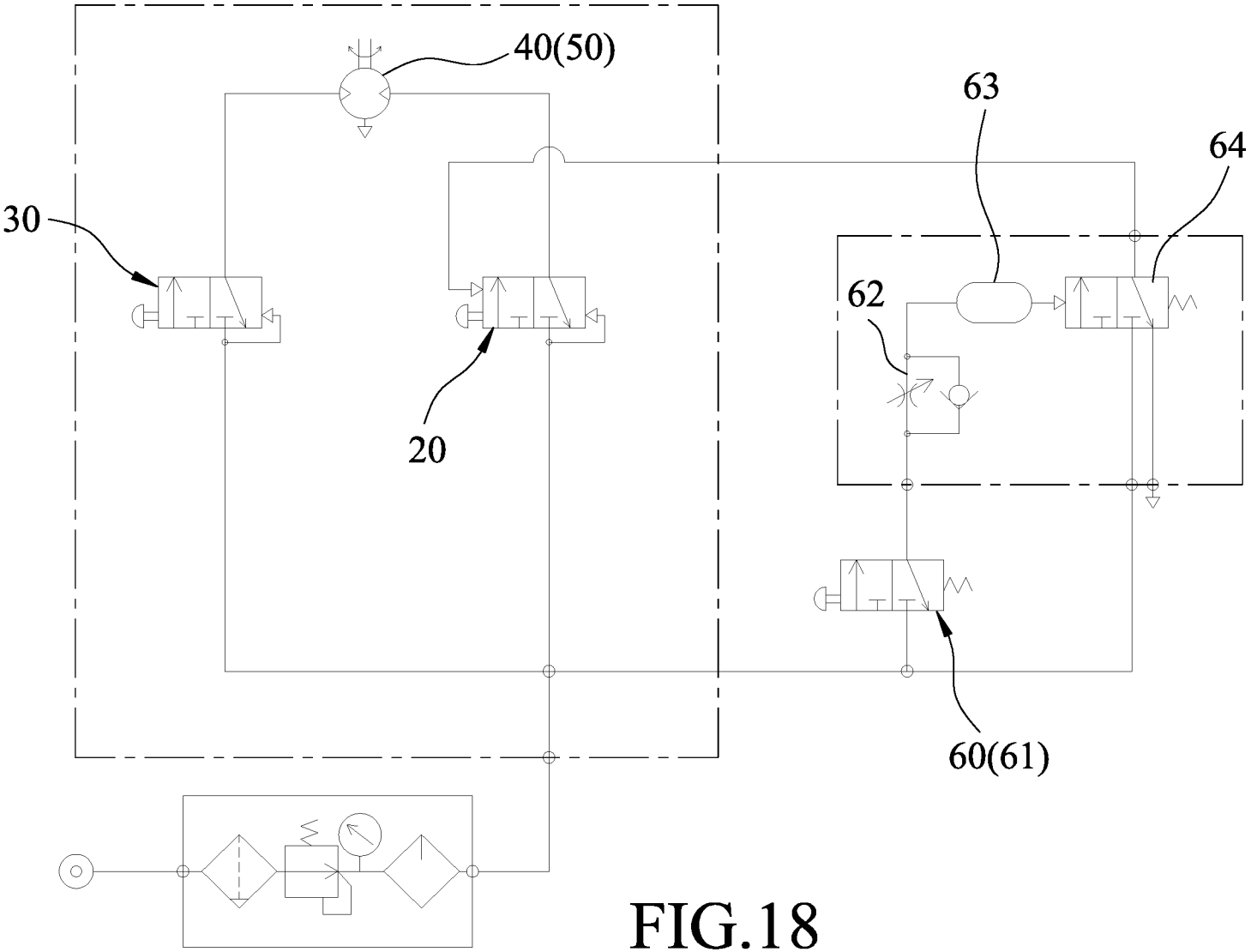
FIG. 18 is a circuit diagram of the embodiment.
Figure 19:
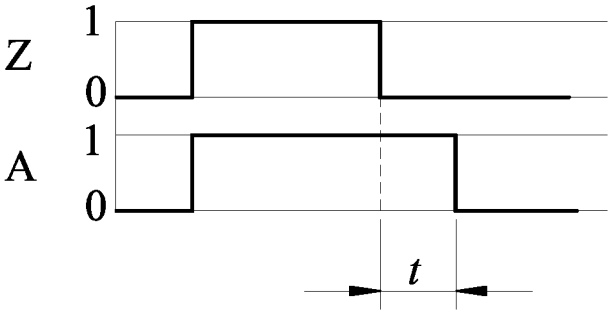
Figure 19:
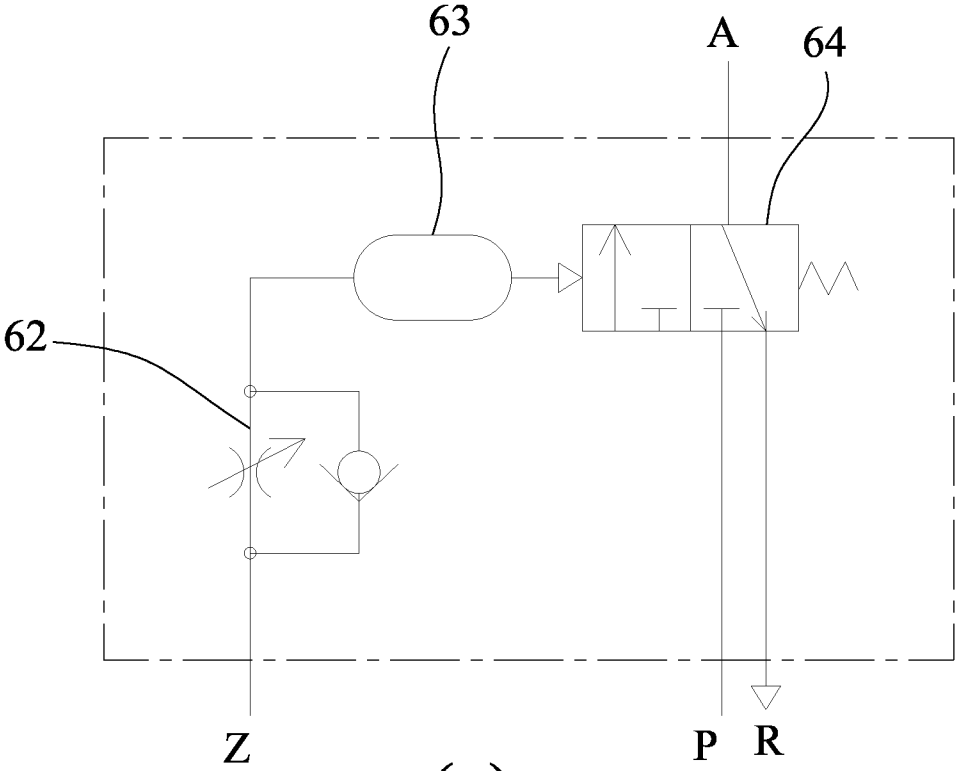
Figure 20:
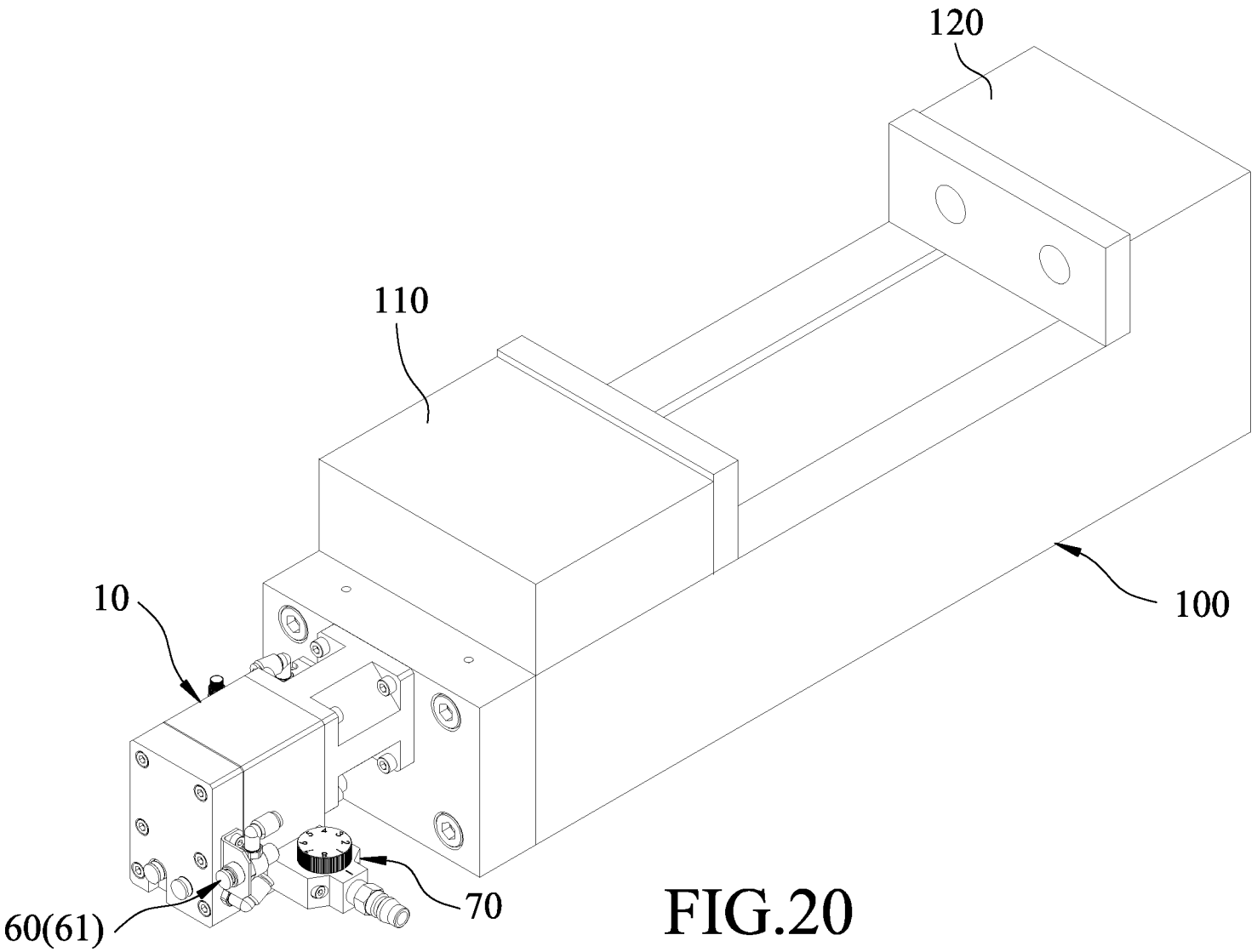
Figure 21:
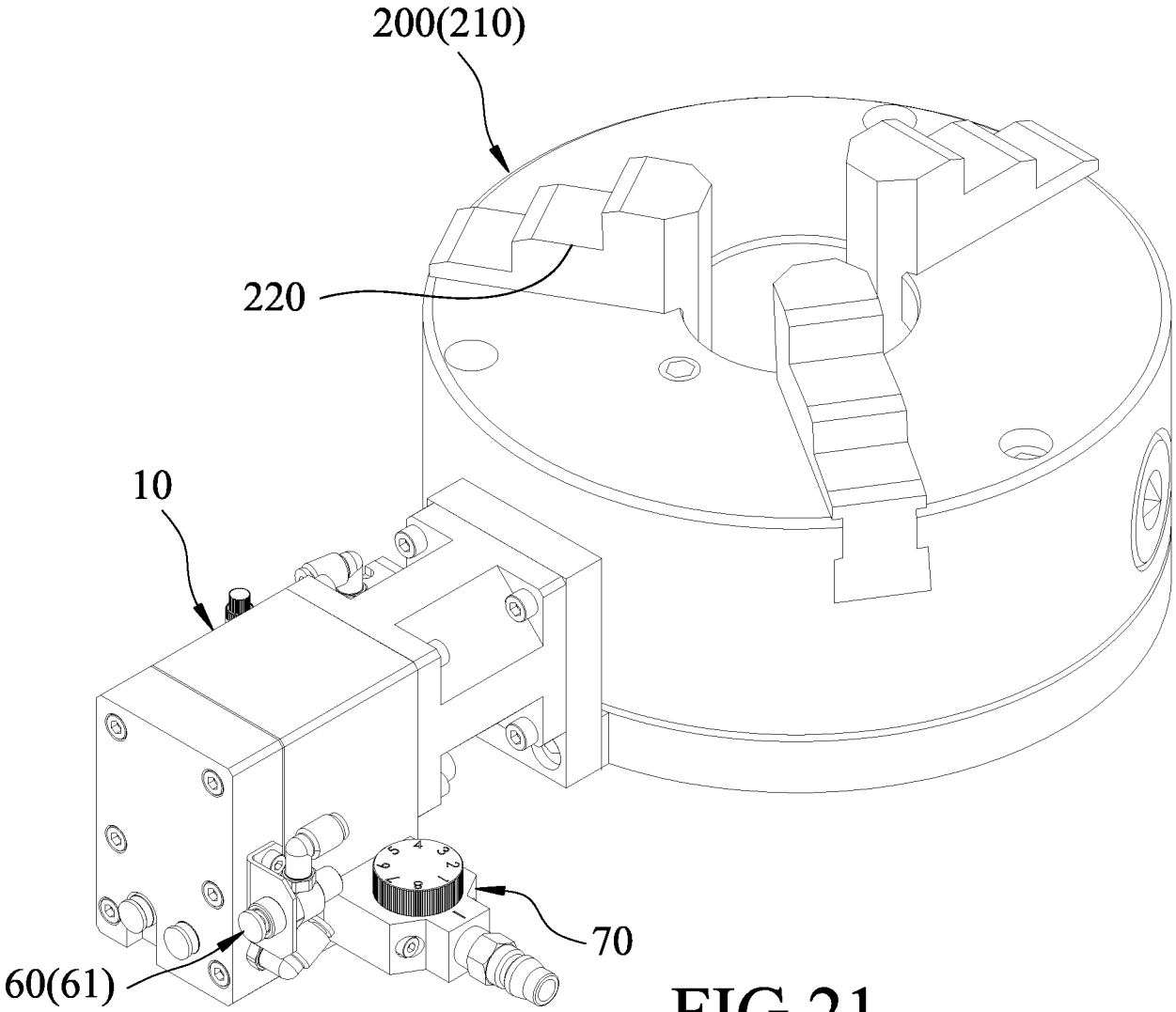

Part (a) of FIG. 19 is an enlarged view of a portion of FIG. 18;

Part (b) of FIG. 19 is a timing diagram illustrating operation of a time-delay unit of the embodiment;

FIG. 20 is a perspective view illustrating the embodiment used in a vise; and FIG. 21 is a perspective view illustrating the embodiment used in a chuck.

DETAILED DESCRIPTION

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 5, the embodiment of the pneumatic control device is adapted to be fluidly connected to a pneumatic supplier (i.e., a compressor, not shown), and includes a base seat unit 10, a first rotation control unit 20, a second rotation control unit 30, a cylinder unit 40, an output unit 50, a time-delay unit 60 and an adjustment unit 70.

The base seat unit 10 extends along an axial line (L), and includes a first base seat 11, a second base seat 12 that is connected to an end of the first base seat 11 along the axial line (L) by bolts, and a rear cover 13 that is connected to another end of the first base seat 11 opposite to the second base seat 12 by bolts. The base seat unit 10 defines an axial hole 14 that extends along the axial line (L) through a junction between the first base seat 11 and the second base seat 12.

The first base seat 11 has a first hole section 111 that extends along the axial line (L), an intake channel 112 that is fluidly connected to the pneumatic supplier, a first retaining space 113 that is fluidly connected to the intake channel 112, a second retaining space 114 that is fluidly connected to the intake channel 112, a first guide channel portion 115' that is fluidly connected to the first retaining space 113, a second guide channel portion 116' that is fluidly connected to the second retaining space 114, a vent hole 117 that fluidly communicates the first hole section 111 with external environment, and a drain groove 118 that is in fluid communication with the vent hole 117. The first hole section 111 is defined by an inner surrounding surface 119 of the first base seat 11 that surrounds the axial line (L). The drain groove 118 is formed in the inner surrounding surface 119, and extends about the axial line (L). The rear cover 13 is formed with a first extending channel portion 115" (see FIG. 3) that fluidly communicates the first guide channel portion 115' with the first hole section 111, and a second extending channel portion 116" (see FIG. 3) that fluidly communicates the second guide channel portion 116' with the first hole section 111. The first guide channel portion 115' and the first extending channel portion 115" cooperatively form a first guide channel 115 that fluidly communicates the first retaining space 113 with the first hole section 111. The second guide channel portion 116' and the second extending channel portion 116" cooperatively form a second guide channel 116 that fluidly communicates the second retaining space 114 with the first hole section 111.

The second base seat 12 has a second hole section 121 that extends along the axial line (L) and that cooperates with the first hole section 111 of the first base seat 11 to form the axial hole 14, and a drain hole 123 (see FIG. 4) that fluidly communicates the second hole section 121 with the external environment. The second hole section 121 is defined by an inner surrounding surface 122 of the second base seat 12 that surrounds the axial line (L).

Figure 9:
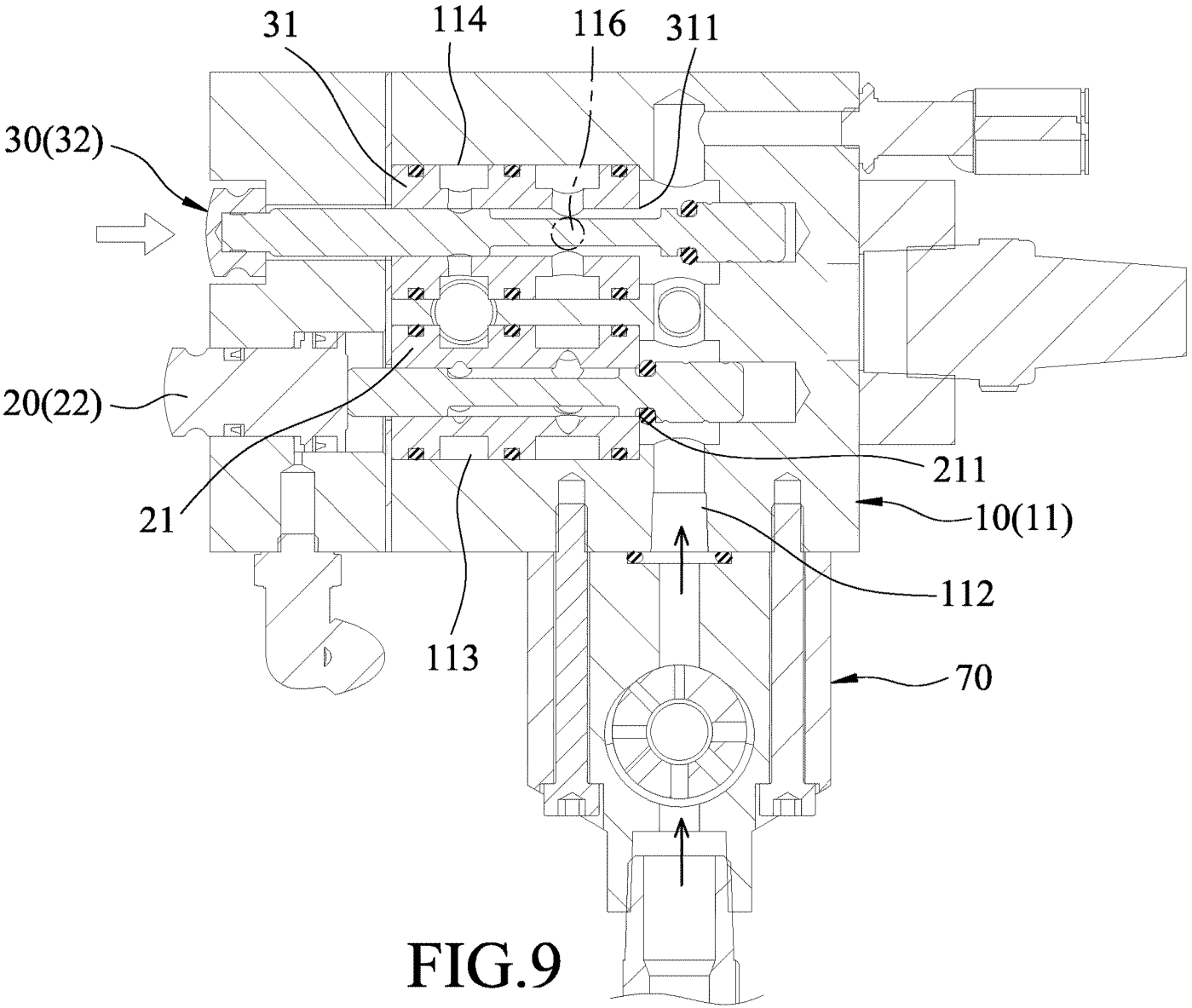
Figure 10:
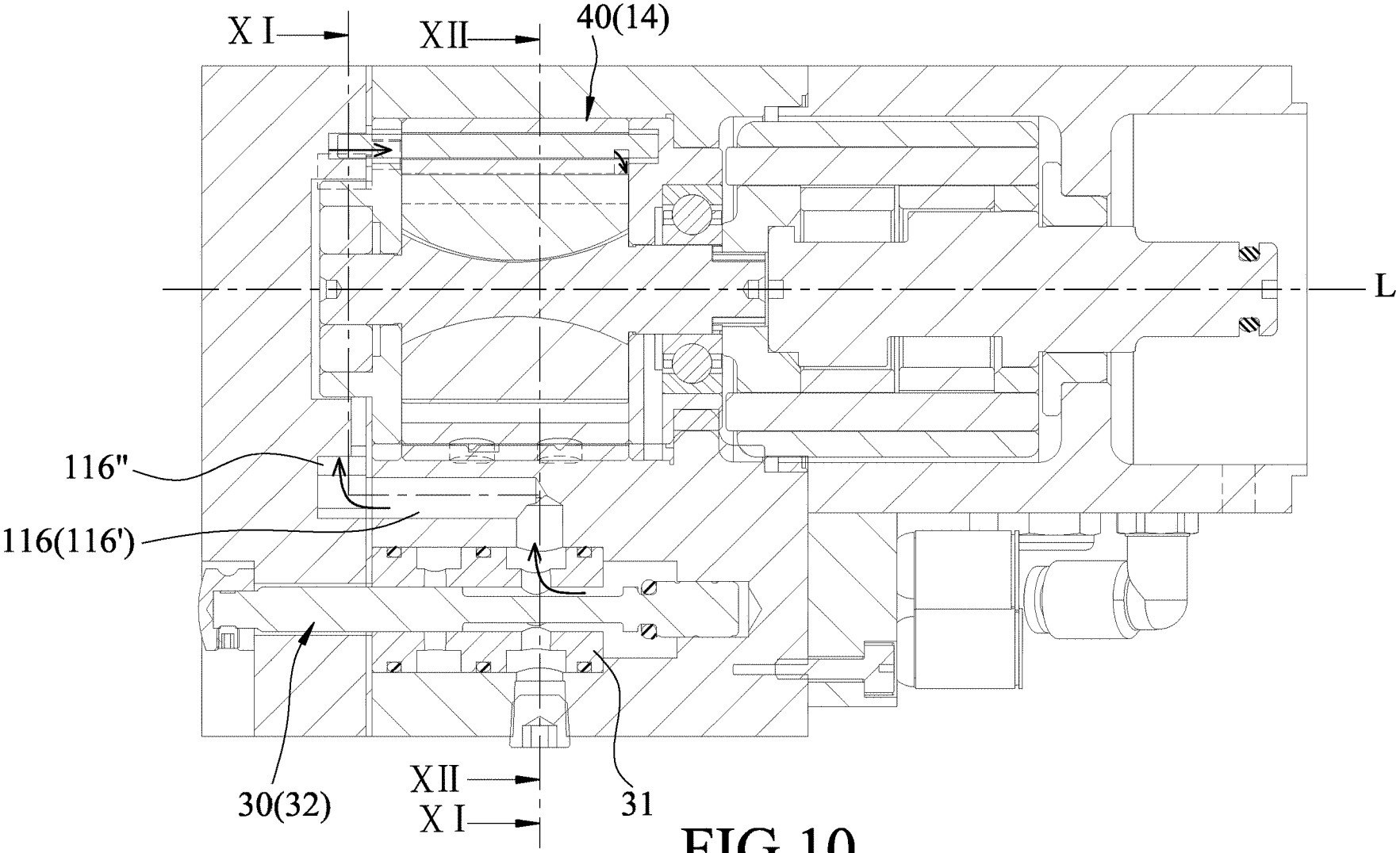
Figure 11:
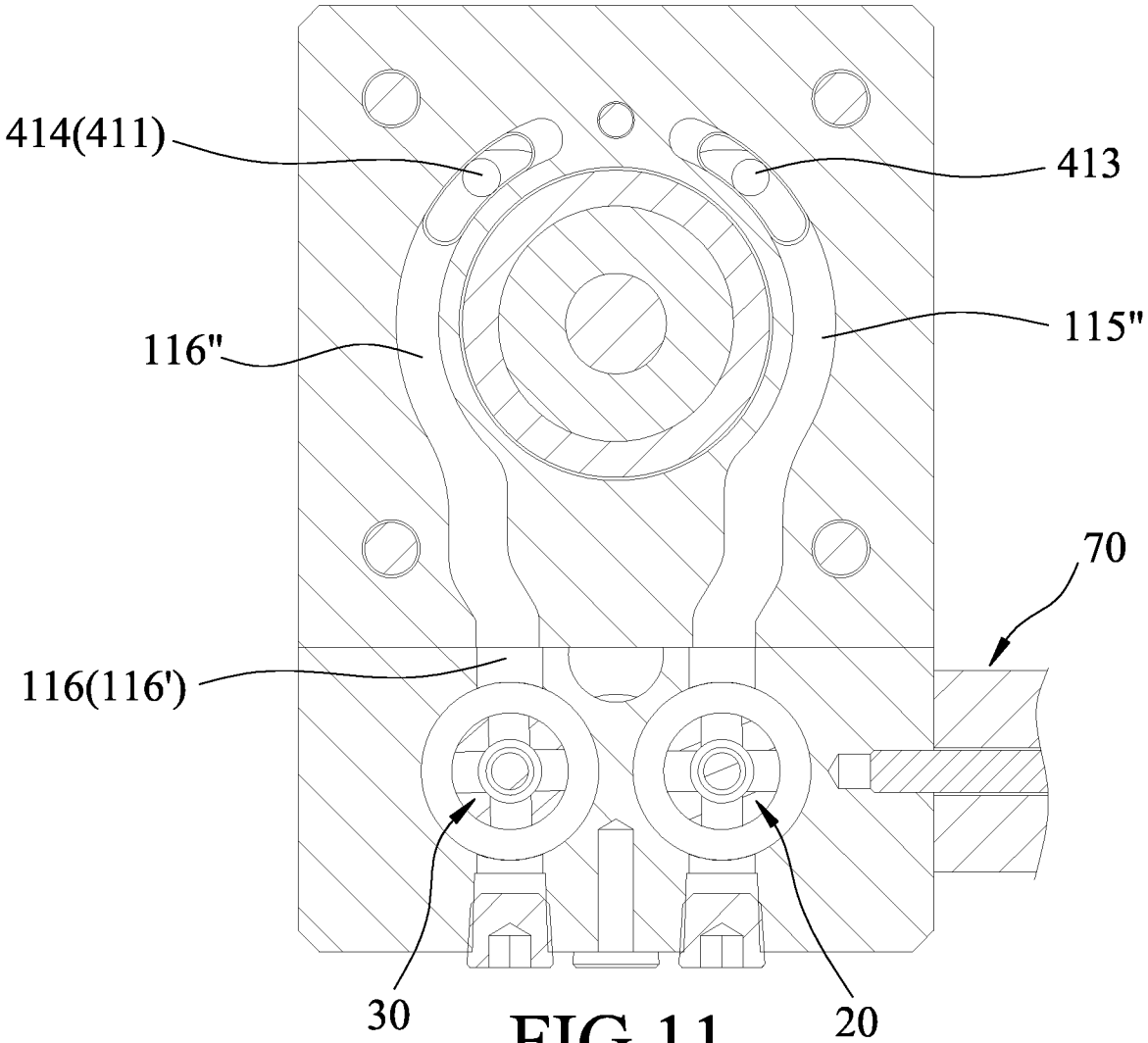
Figure 12:
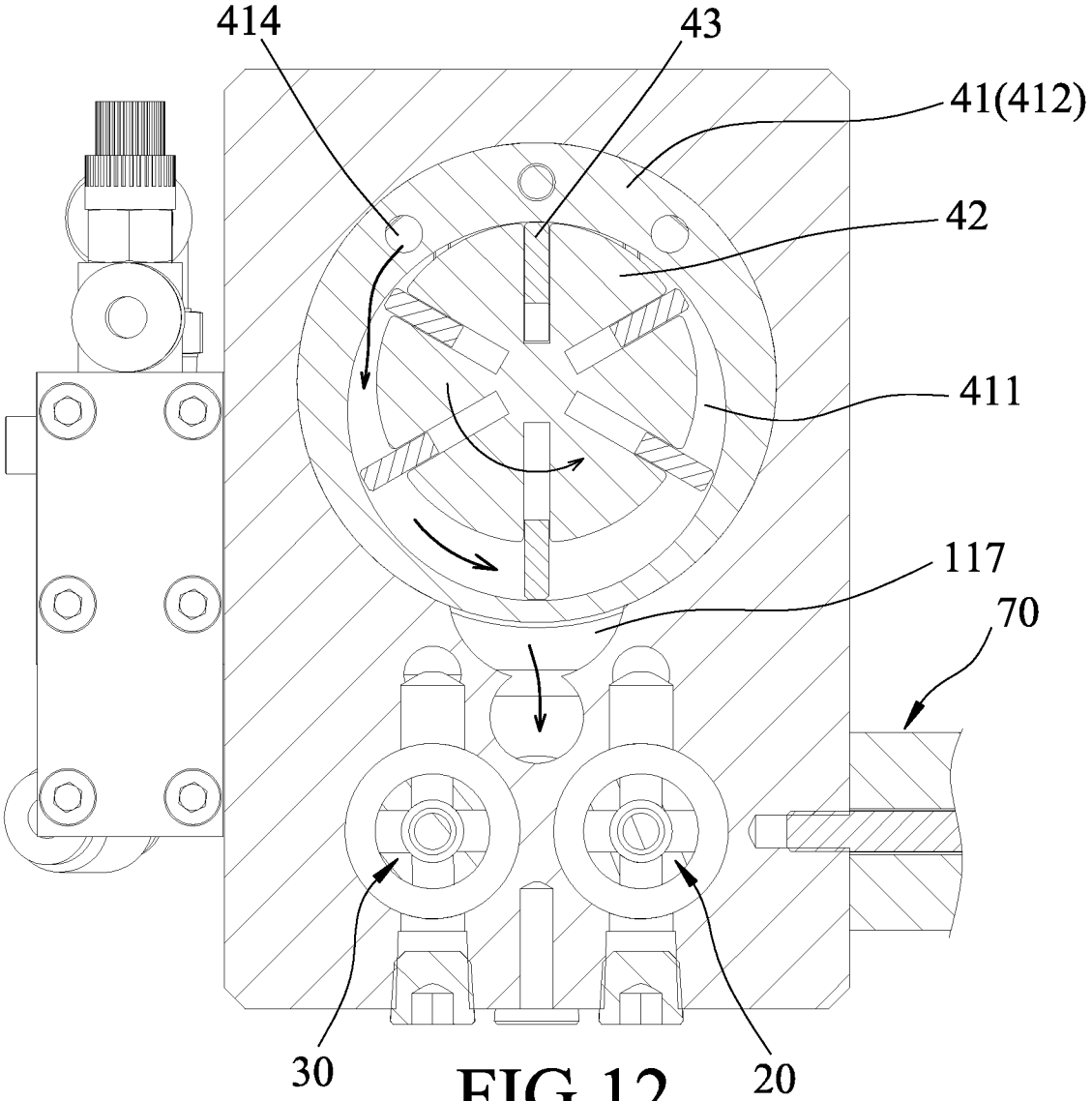
Figure 13:
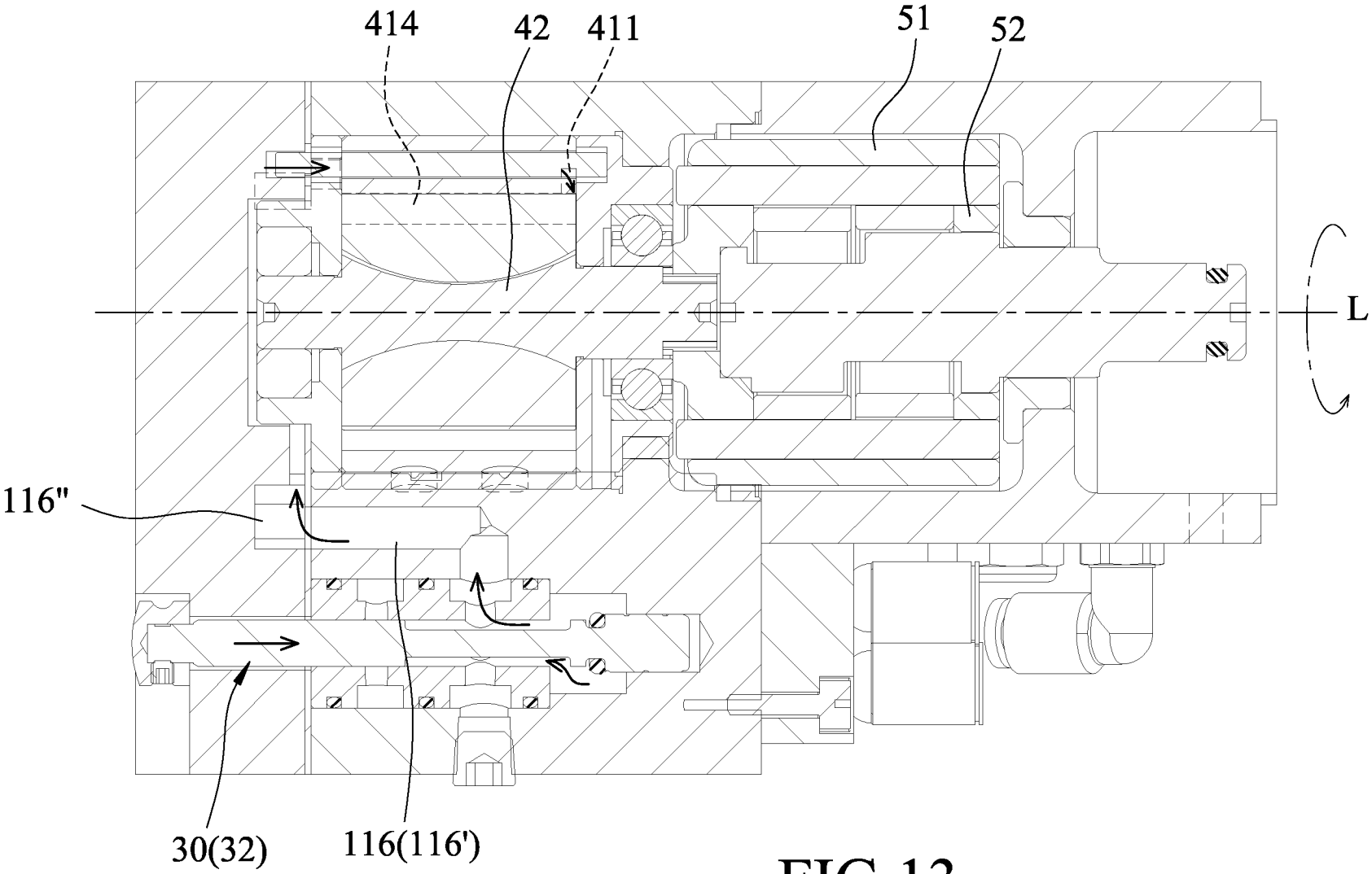
Figure 14:
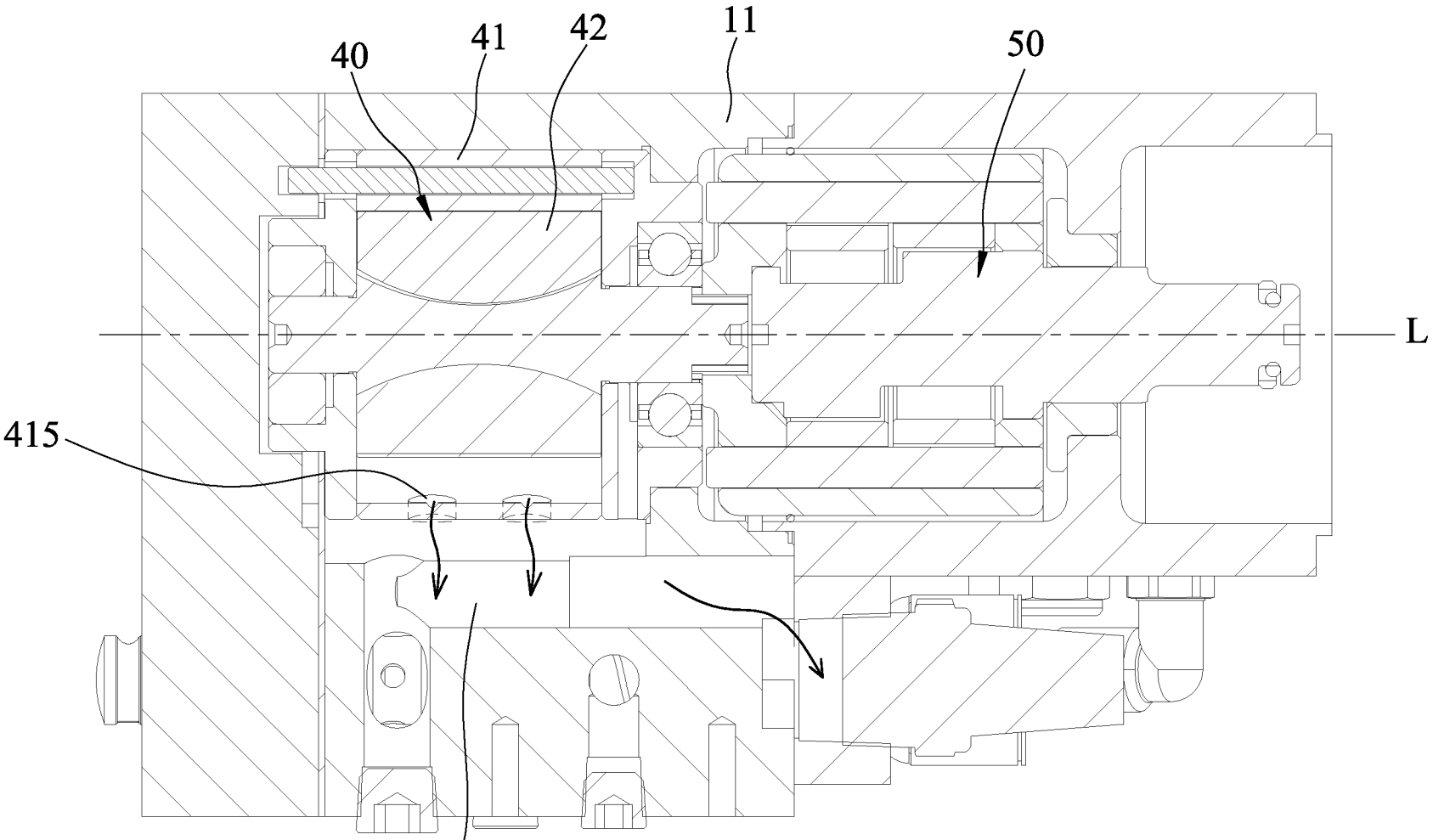
Figure 15:
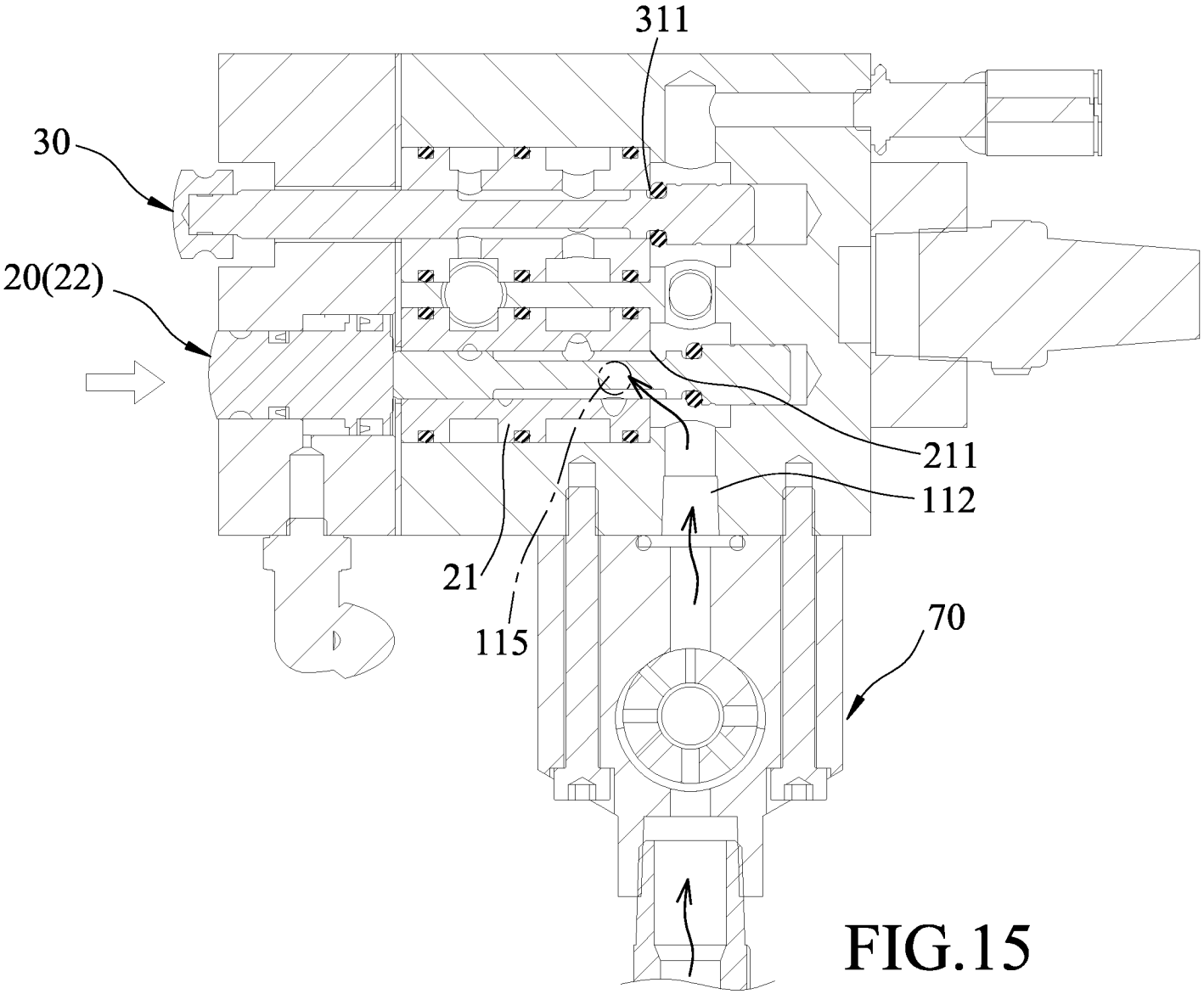
Figure 16:
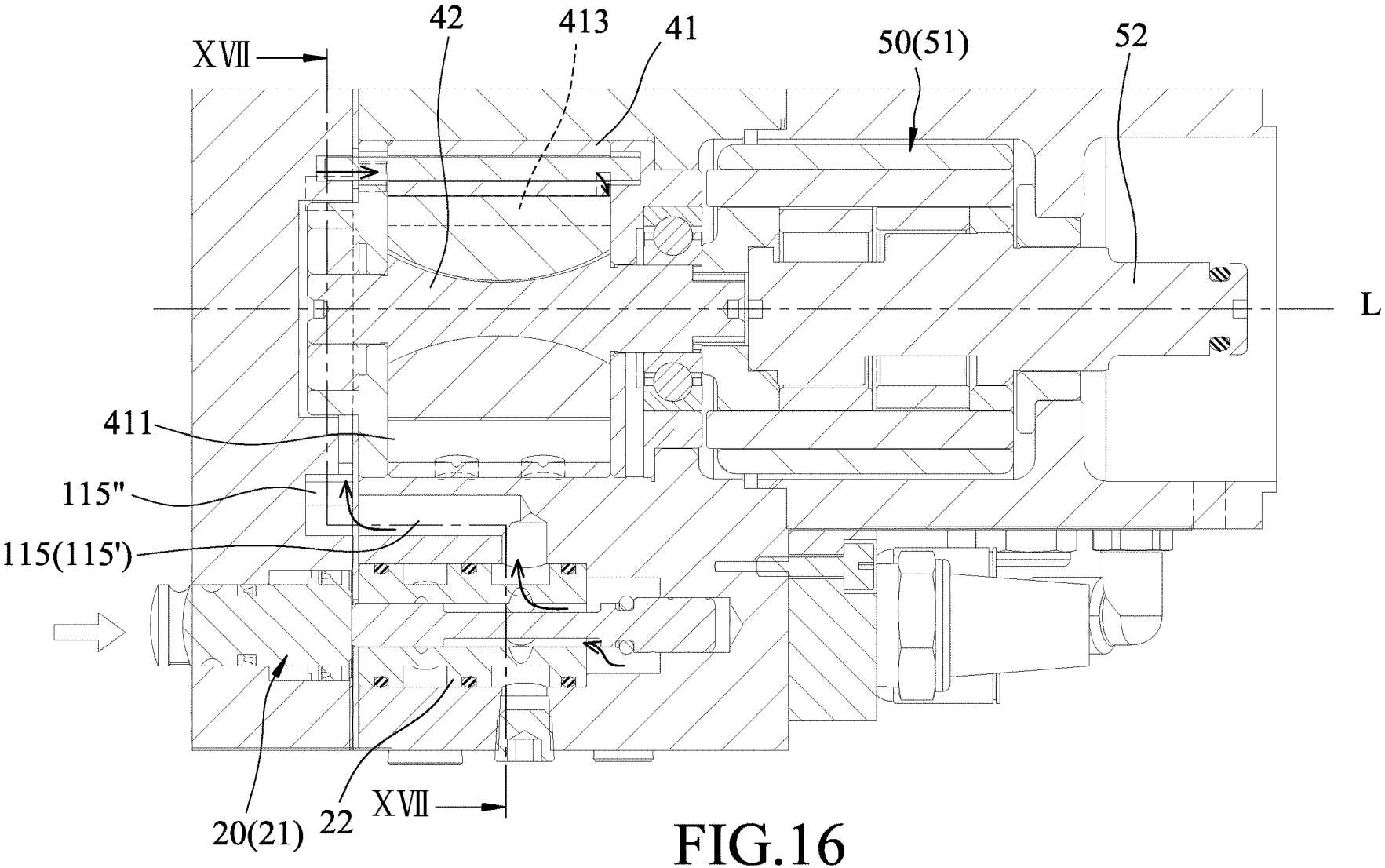
Figure 17:
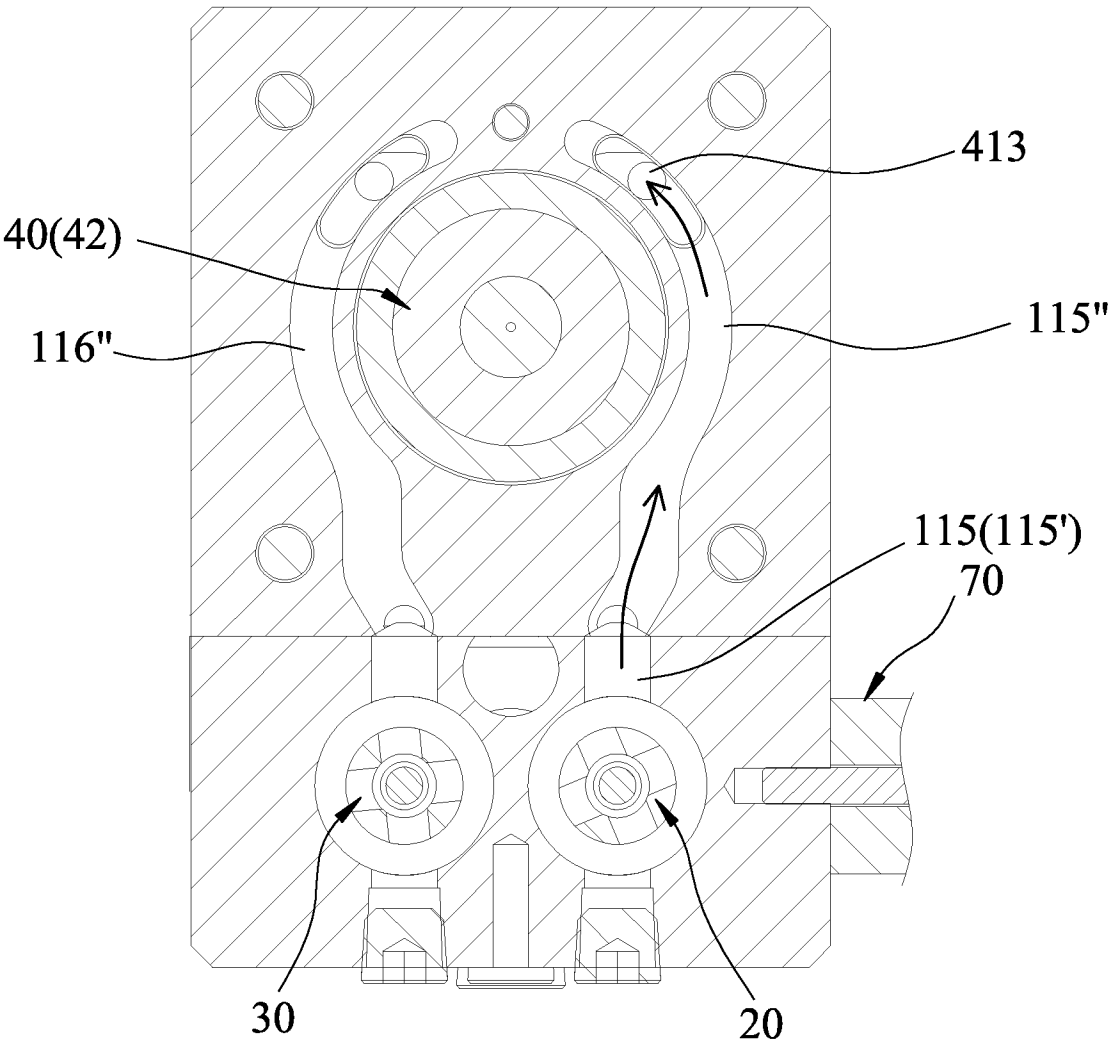

The first rotation control unit 20 is configured as a three-port two-position valve, is installed in the first retaining space 113, and includes a first valve seat 21 (see FIG. 5) that is mounted to the first retaining space 113, and a first valve rod 22 that is slidably mounted to the first valve seat 21. When the first valve rod 22 is at an action position (i.e., is depressed, see FIG. 15), fluid communication between the intake channel 112 and the first guide channel 115 via a first opening 211 (see FIG. 15) of the first valve seat 21 is permitted. When the first valve rod 22 is at a non-action position (i.e., is released, see FIG. 9), fluid communication between the intake channel 112 and the first guide channel 115 via the first opening 211 is prevented.

The second rotation control unit 30 is configured as a three-port two-position valve, is installed in the second retaining space 114, and includes a second valve seat 31 (see FIG. 5) that is mounted to the second retaining space 114, and a second valve rod 32 that is slidably mounted to the second valve seat 31. When the second valve rod 32 is at an action position (i.e., is depressed, see FIG. 9), fluid communication between the intake channel 112 and the second guide channel 116 via a second opening 311 (see FIG. 9) of the second valve seat 31 is permitted. When the second valve rod 32 is at a non-action position (i.e., is released, see FIG. 15), fluid communication between the intake channel 112 and the second guide channel 116 via the second opening 311 is prevented.

The cylinder unit 40 is installed in the first hole section 111 of the base seat unit 10. The cylinder unit 40 drives a first rotational movement about the axial line (L) when a fluid flows thereinto from the first guide channel 115, and to drives a second rotational movement opposite to the first rotational movement about the axial line (L) when a fluid flows thereinto from the second guide channel 116. In one embodiment, the cylinder unit 40 includes a cylinder 41 that is mounted in the first hole section 111, a rotor 42 that is mounted in the cylinder 41, and a plurality of angularly spaced-apart vanes 43 that are mounted to the rotor 42. The cylinder 41 has a cylinder wall 412 that defines a chamber 411 therein. The chamber 411 is eccentric with respect to the axial line (L). The cylinder wall 412 is formed with a first inlet 413 (see FIGS. 3 and 6) that is parallel to the axial line (L) and that fluidly communicates the first guide channel 115 with the chamber 411, a second inlet 414 that is parallel to the axial line (L) and that fluidly communicates the second guide channel 116 with the chamber 411, and two communication holes 415 (see FIG. 6) that fluidly communicate the vent hole 117 with the chamber 411. The rotor 42 has an outer surrounding surface 421 that surrounds the axial line (L), a plurality of angularly spaced-apart slide grooves 422 that are formed in the outer surrounding surface 421, and a connecting axle portion 423. The vanes 43 are respectively and slidably mounted in the slide grooves 422.

Figure 1:
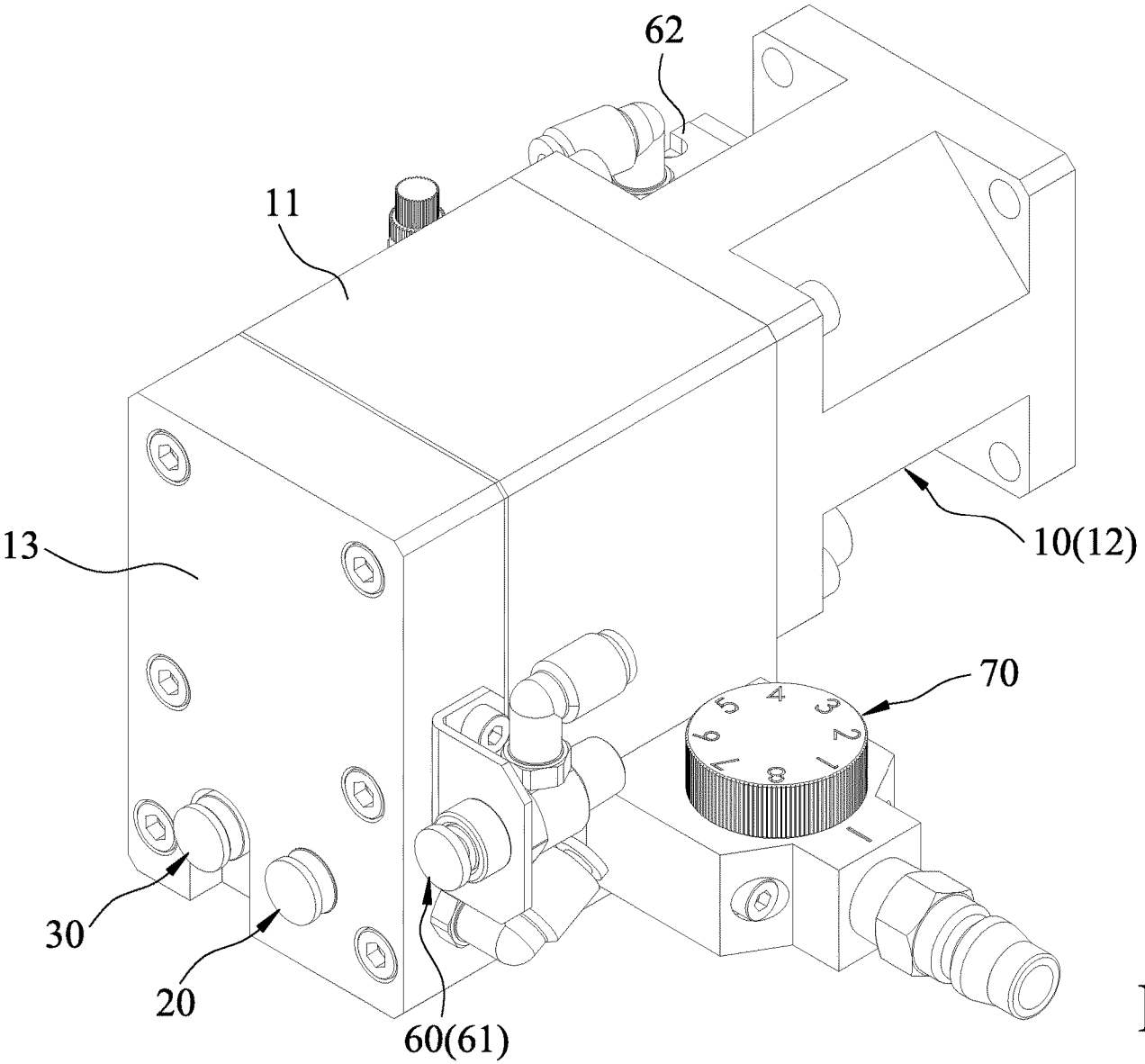
FIG. 1 is a perspective view illustrating an embodiment of a pneumatic control device according to the disclosure.
Figure 2:
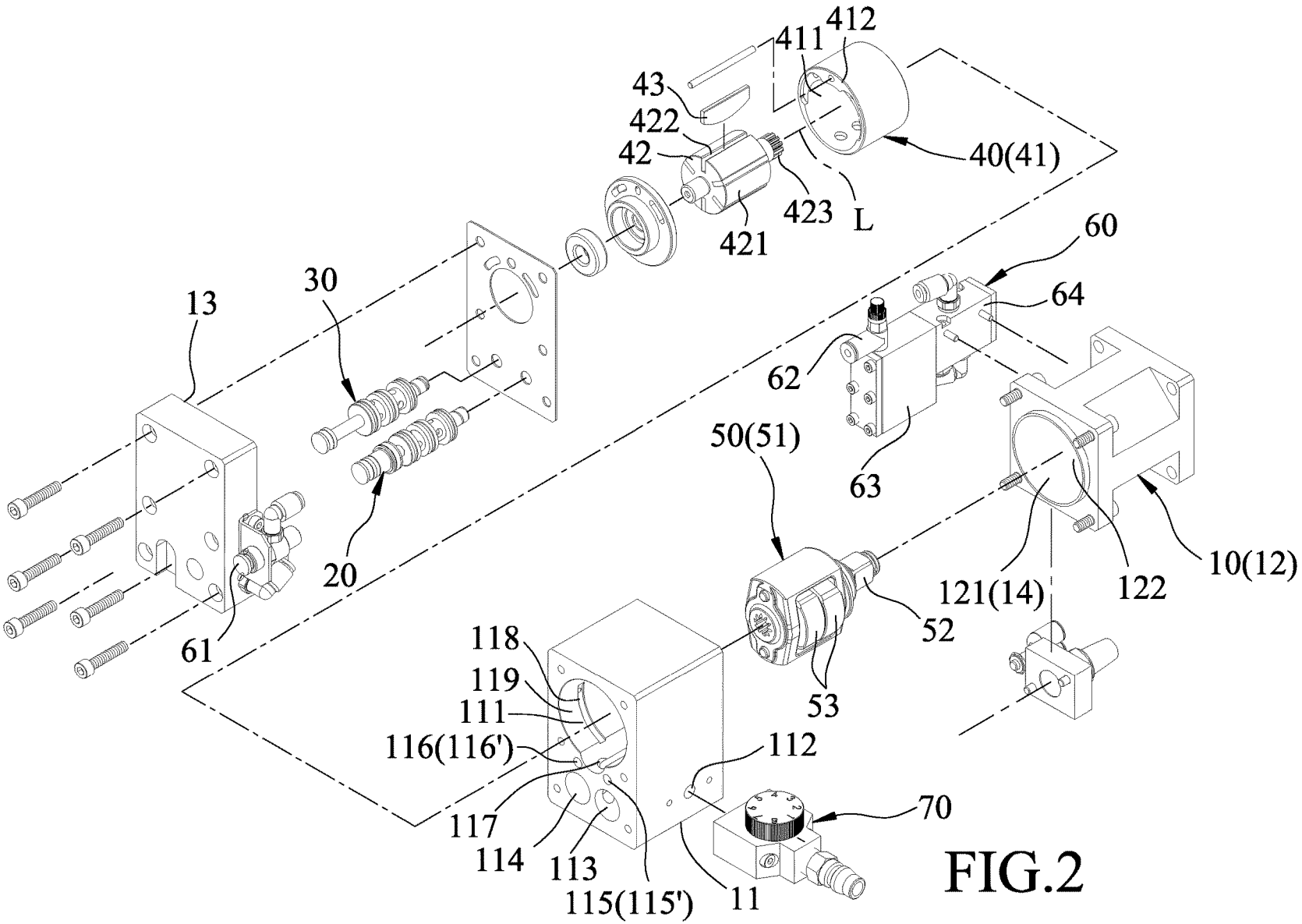
FIG. 2 is a partly exploded perspective view of the embodiment.
Figure 3:
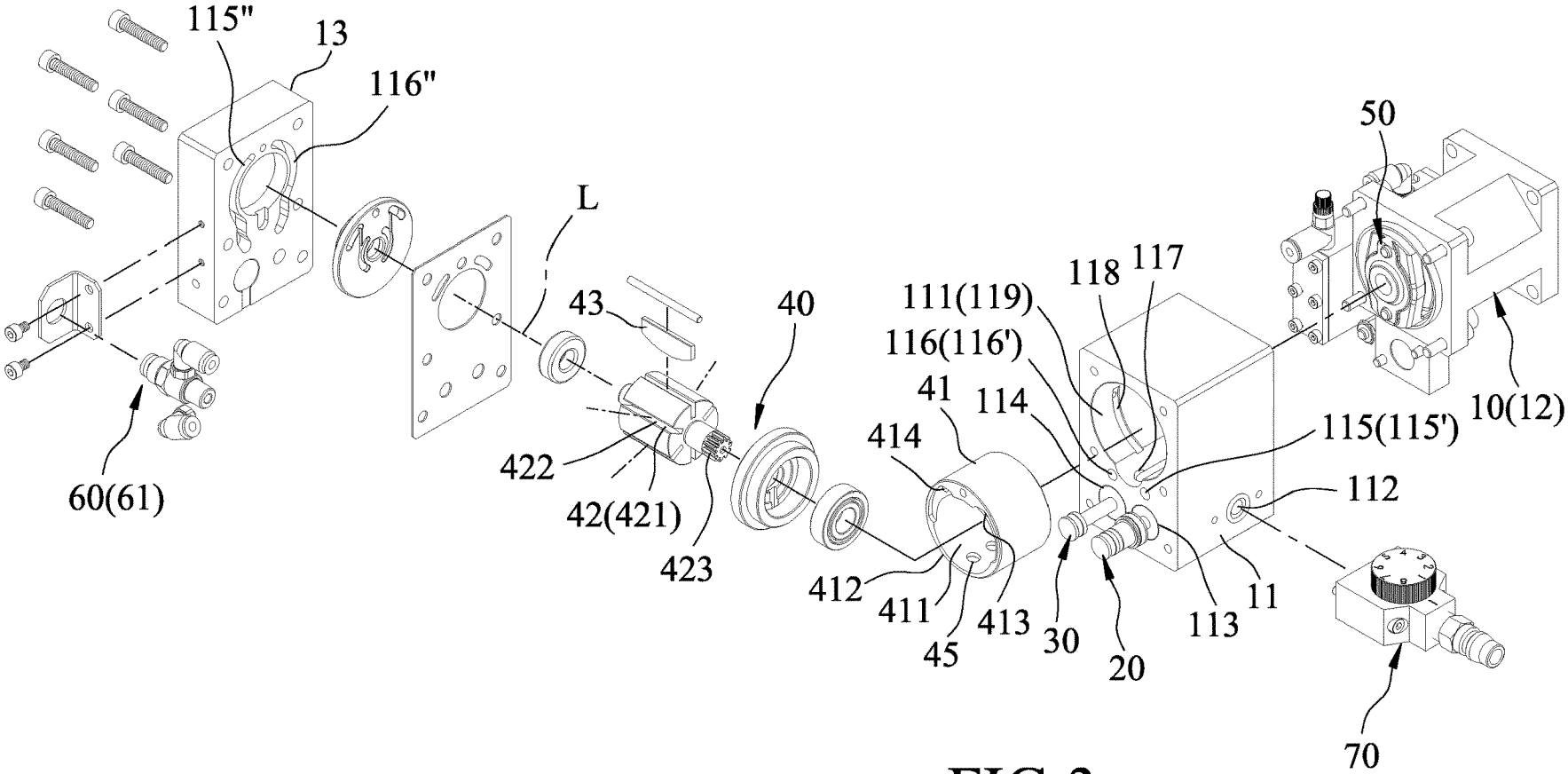
FIG. 3 is another partly exploded perspective view of the embodiment.
Figure 4:
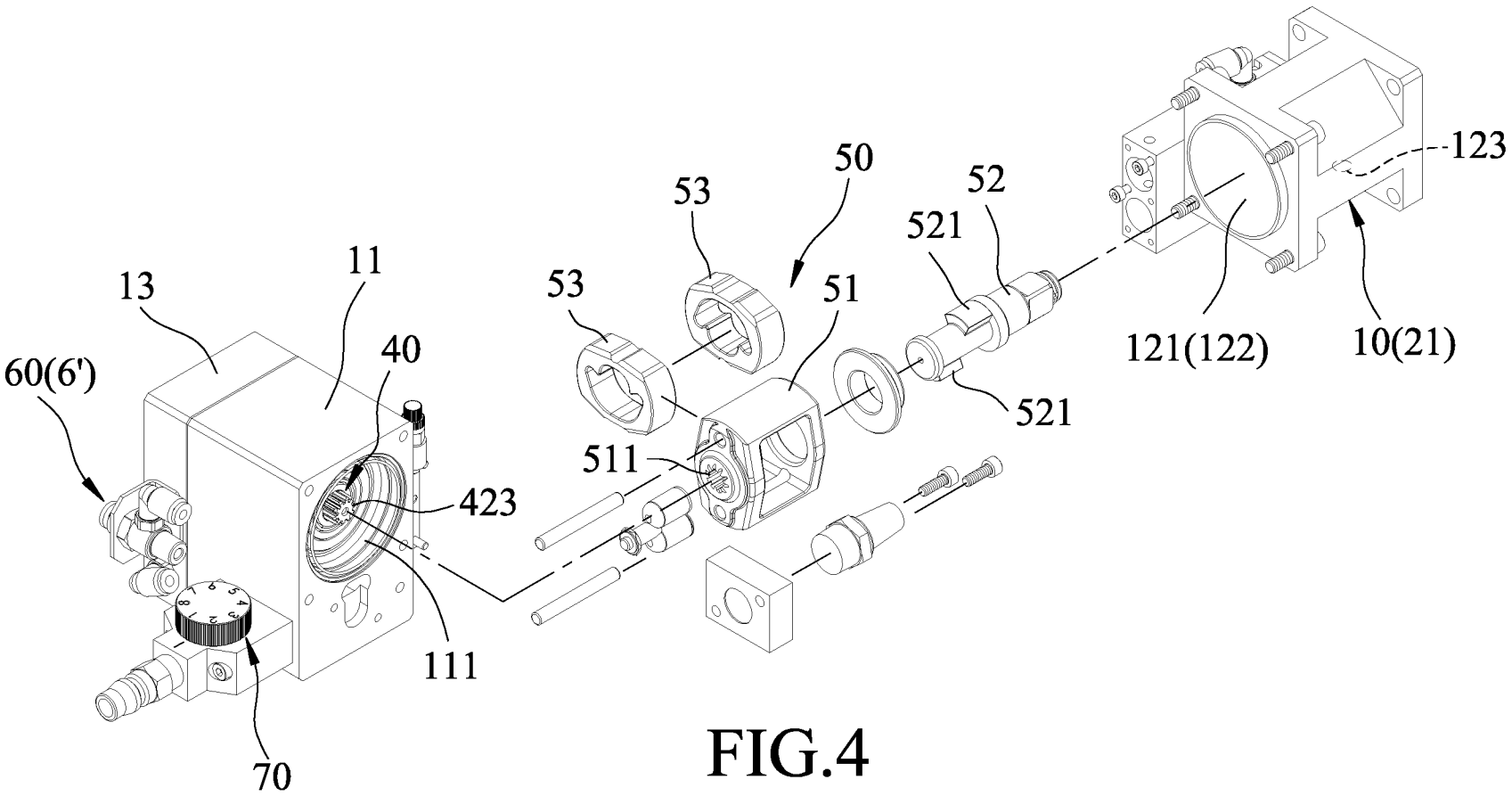
FIG. 4 is still another partly exploded perspective view of the embodiment.
Figure 5:
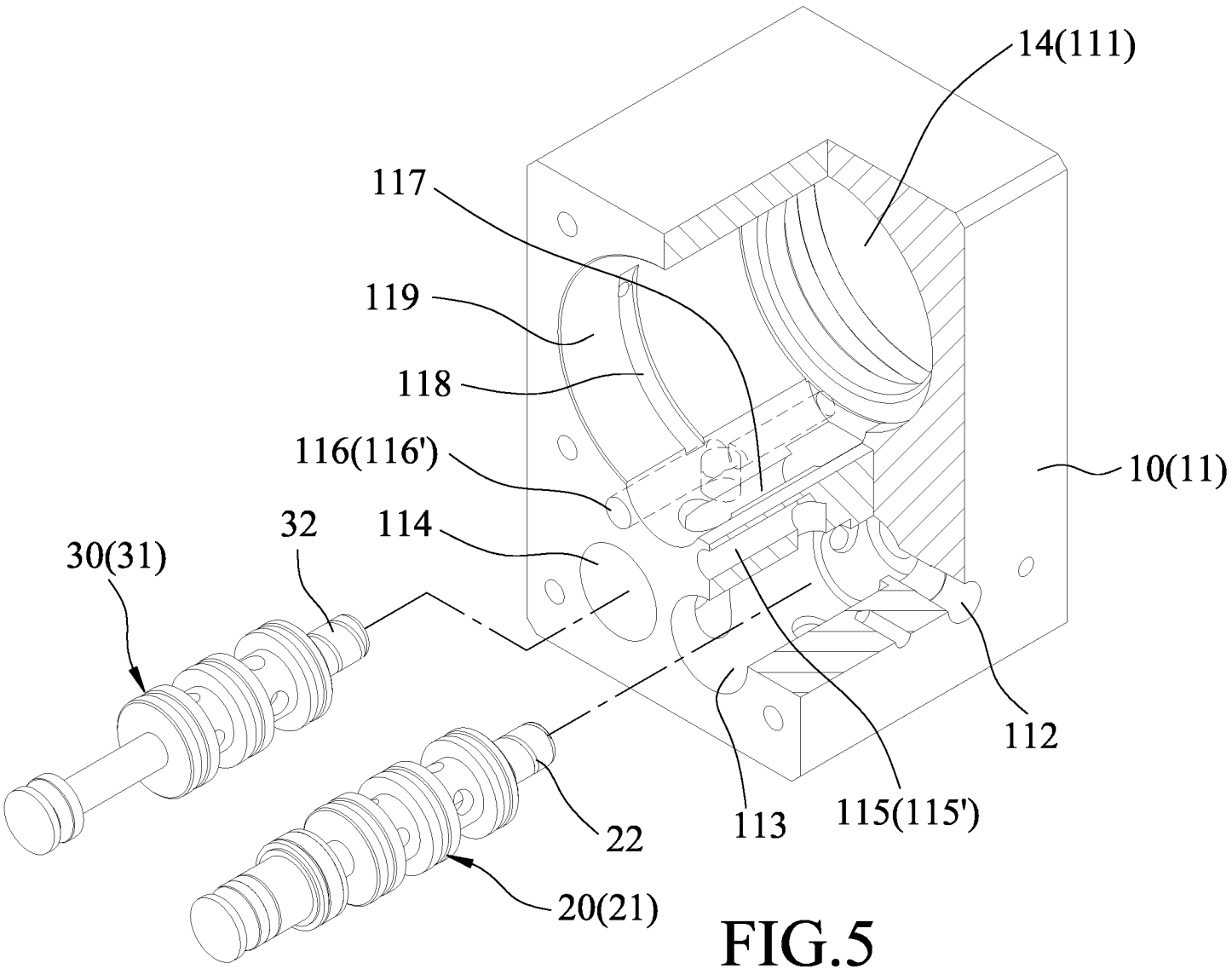
FIG. 5 is a exploded perspective view illustrating a first base seat, a first rotation control unit and a second rotation control unit of the embodiment.

The output unit 50 is installed in the second hole section 121 of the base seat unit 10, and is connected to an end of the cylinder unit 40 along the axial line (L) for outputting the rotation generated by the cylinder unit 40. With particular reference to FIG. 4, the output unit 50 includes a cage 51 that is co-rotatably connected to the rotor 42, an output shaft 52 that is mounted to the cage 51, and two hammers 53 that are pivotally connected to the cage 51 for driving rotation of the output shaft 52. The cage 51 has a coupling hole 511 that is co-rotatably engaged with the connecting axle portion 423 of the rotor 42. The output shaft 52 has two struck portions 521 that respectively correspond in position to the hammers 53. The hammers 53 are driven by the rotor 42 (via the cage 51) to strike the output shaft 52 so as to drive the rotation of the output shaft 52. In a modification, the output unit 50 may include only a hammer 53, and the output shaft 52 may have only a struck portion 521.

Referring further to FIG. 18, the time-delay unit 60 is configured to be off-delay type, is mounted to the base seat unit 10, and includes a delay switch 61 that is fluidly connected to the pneumatic supplier, a flow-limiting valve 62 that is connected downstream of the delay switch 61, a pressure accumulator 63 that is connected downstream of the flow-limiting valve 62, and a control valve 64 that is connected downstream of the pressure accumulator 63 and that is fluidly connected to the first retaining space 113 and the pneumatic supplier. In one embodiment, the delay switch 61 is fluidly connected to the pneumatic supplier via the intake channel 112. The flow-limiting valve 62 is adjustable in flow rate. The control valve 64 is configured as a three-port two-position valve. Referring further to FIG. 19, by virtue of the configuration of the time-delay unit 60, when the delay switch 61 is at an action position (i.e., the delay switch 61 is depressed), the control valve 64 permits fluid communication between the pneumatic supplier and the first retaining space 113 therethrough. When the delay switch 61 is moved to a non-action position (i.e., the delay switch 61 is released), the control valve 64 maintains the fluid communication between the pneumatic supplier and the first retaining space 113 for a predetermined period of time (t) and then prevents the fluid communication between the pneumatic supplier and the first retaining space 113 (see part (b) of FIG. 19). In FIG. 19, symbol (Z) denotes fluid communication between the delay switch 61 and the flow-limiting valve 62, symbol (A) denotes fluid communication between the control valve 64 and the first retaining space 113, symbol (P) denotes fluid communication between the control valve 64 and the pneumatic supplier, and symbol (R) denotes fluid communication between the control valve 64 and the external environment.

The adjustment unit 70 is mounted to the base seat unit 10, and is fluidly connected between the intake channel 112 and the pneumatic supplier for adjusting flow rate of pressured air flowing into the intake channel 112.

Figure 6:
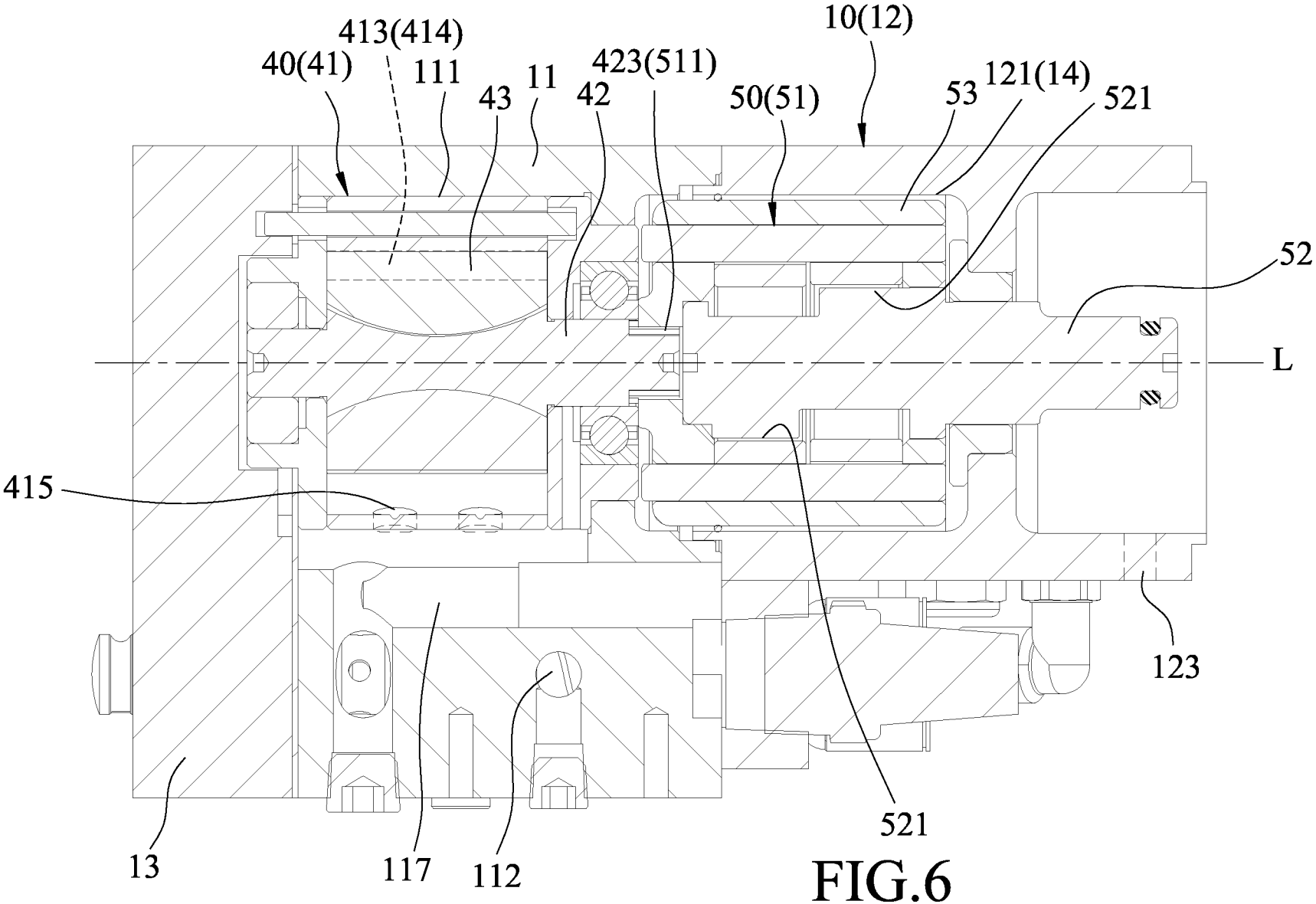
FIG. 6 is a sectional view of the embodiment.
Figure 7:
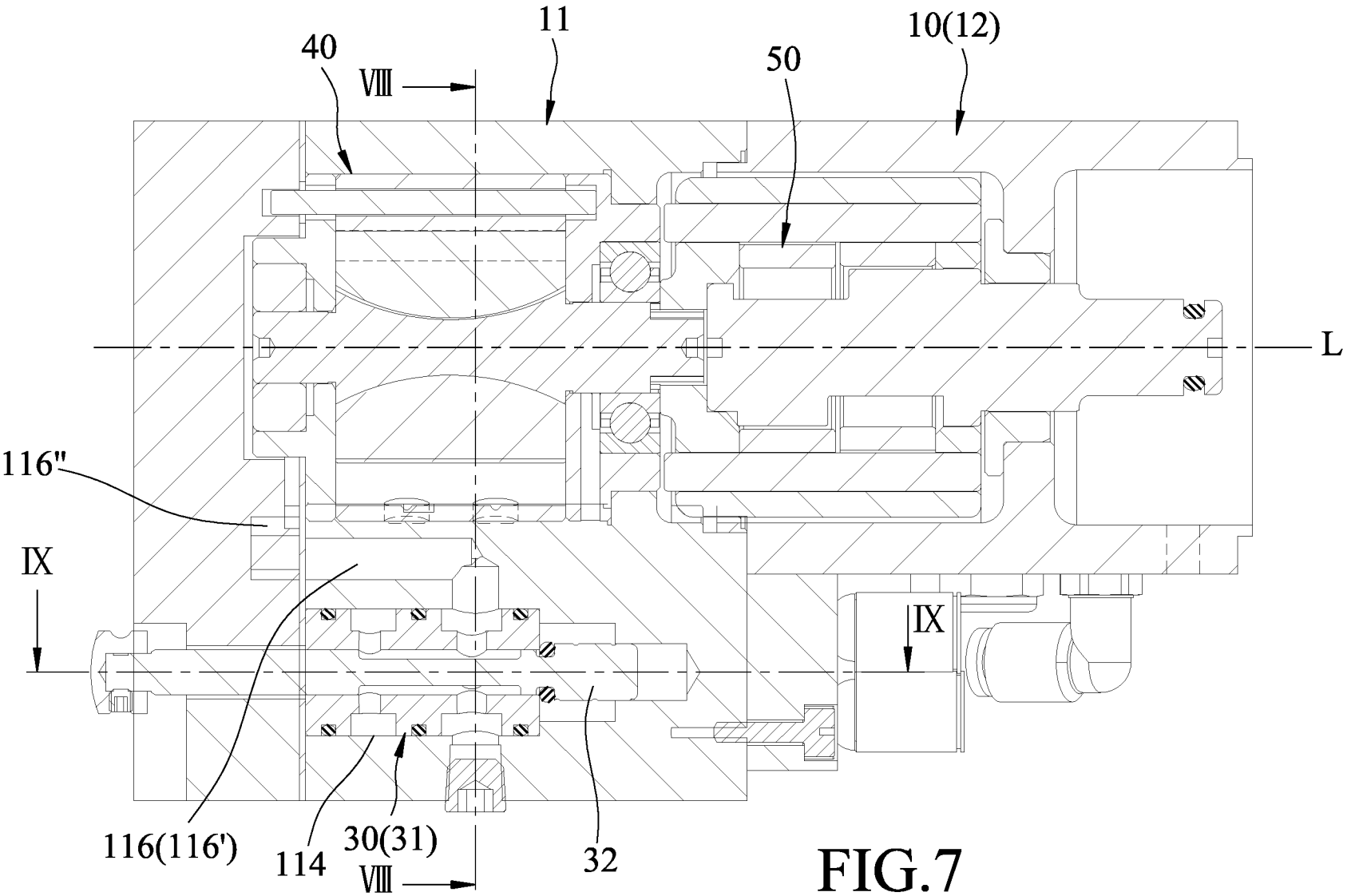
FIG. 7 is another sectional view of the embodiment.
Figure 8:
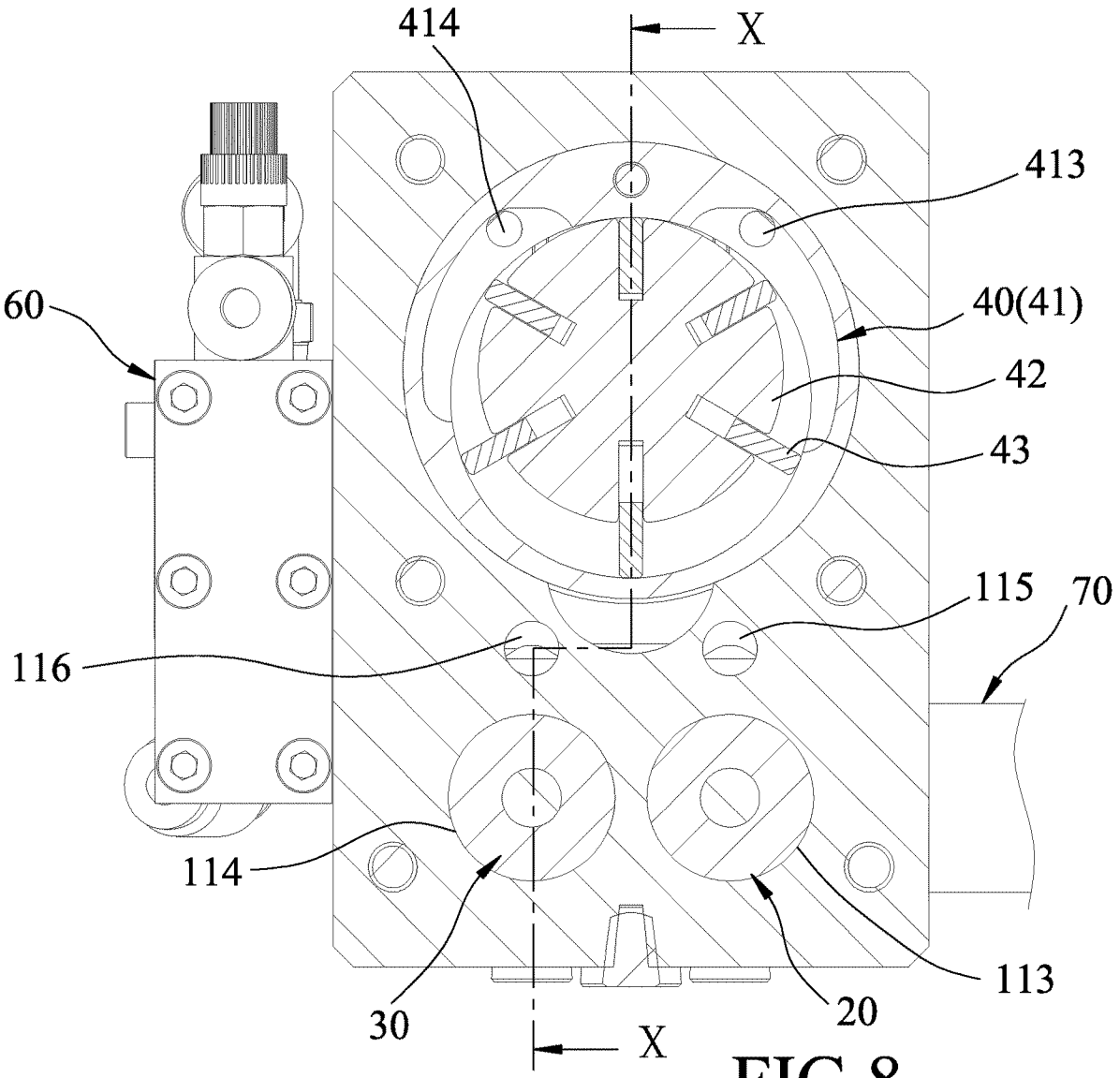
FIG. 8 is still another sectional view of the embodiment taken along line VIII-VIII in FIG. 7.

Referring further to FIGS. 6 to 8, the first rotation control unit 20, the second rotation control unit 30, and the delay switch 61 are normally-closed type (i.e., are normally at the non-action position).

Referring to FIGS. 9 to 14, 18 and 19, when the second valve rod 32 of the second rotation control unit is depressed to move to the action position, pressured air is permitted to flow from the pneumatic supplier into the second guide channel 116 via the adjustment unit 70, the intake channel 112, the second retaining space 114 and the second opening 311, and then to flow into the chamber 411 via the second inlet 414 to drive rotation of the rotor 42 in a first direction for rotating the output shaft 52. The expanded air in the chamber 411 is expelled to the external environment via the communication holes 415 and the vent hole 117.

Referring to FIGS. 15 to 18, when the first valve rod 22 of the first rotation control unit 20 is depressed to move to the action position, pressured air is permitted to flow from the pneumatic supplier into the first guide channel 115 via the adjustment unit 70, the intake channel 112, the first retaining space 113 and the first opening 211, and then to flow into the chamber 411 via the first inlet 413 to drive rotation of the rotor 42 in a second direction opposite to the first direction for rotating the output shaft 52. Similarly, the expanded air in the chamber 411 is expelled to the external environment via the communication holes 415 and the vent hole 117.

Referring to FIGS. 18 and 19, when the delay switch is depressed to move to the action position, pressured air is permitted to flow from the pneumatic supplier into the first guide channel 115 via adjustment unit 70, the intake channel 112, the control valve 64 and the first retaining space 113, and then to flow into the chamber 411 via the first inlet 413 to drive rotation of the rotor 42 in the second direction opposite to the first direction for rotating the output shaft 52. When the delay switch 61 is released to move to the non-action position, the control valve 64 maintains the fluid communication between the pneumatic supplier and the first retaining space 113 fora predetermined period of time (t) and then prevents the fluid communication between the pneumatic supplier and the first retaining space 113, so that the output shaft 52 continues to be driven by rotation of the rotor in the second direction to rotate for the predetermined period of time (t) after the delay switch 61 is released.

The pneumatic control device according to the disclosure is able to be used in various application fields that need rotational mechanical input. Referring to FIG. 20, for use in a vise 100, the output shaft 52 is coupled to a leadscrew (not shown) of the vise 100 to drive linear movement of a movable jaw 110 relative to a fixed jaw 120 for securing a workpiece (not shown) via a clamping force with a preset value. By operating the delay switch 61, the movable jaw 110 can promptly cease to move relative to the fixed jaw 120, such that the magnitude of the clamping force exerted by the movable and fixed jaws 110, 120 and applied to the workpiece is substantially the same as the preset value.

Referring to FIG. 21, for use in a chuck 200, the output shaft 52 is coupled to a transmission element (not shown) of the chuck 200 to drive movement of angularly spaced-apart jaws 220 relative to a main body 210 of the chuck 200. Similarly, by operating the delay switch 61, the jaws 220 can promptly cease to move relative to the main body 210, such that the magnitude of a clamping force exerted by the jaws 220 is substantially the same as a preset value.

By operating the adjustment unit 70, the rotational speed, the output power or the loading capability of the output shaft 52 can be adjusted. In a modification, the adjustment unit 70 may be omitted, and the pneumatic supplier is directly and fluidly connected to the intake channel 112.

By virtue of the presence of the drain groove 118 and the drain hole 123, water accumulated in the first base seat 11 and the second base seat 12 can be expelled to the external environment.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A pneumatic control device adapted to be fluidly connected to a pneumatic supplier, comprising:

a base seat unit having an axial hole that extends along an axial line, an intake channel that is adapted to be fluidly connected to the pneumatic supplier, a first retaining space that is fluidly connected to said intake channel, a second retaining space that is fluidly connected to said intake channel, a first guide channel that fluidly communicates said first retaining space with said axial hole, a second guide channel that fluidly communicates said second retaining space with said axial hole, and a vent hole that fluidly communicates said axial hole with external environment;

a first rotation control unit installed in said first retaining space, and operable to move between at an action position whereat fluid communication between said intake channel and said first guide channel is permitted, and a non-action position whereat the fluid communication between said intake channel and said first guide channel is prevented;

a second rotation control unit installed in said second retaining space, and operable to move between an action position whereat fluid communication between said intake channel and said second guide channel is permitted, and a non-action position whereat the fluid communication between said intake channel and said second guide channel is prevented;

a cylinder unit installed in said axial hole of said base seat unit, and able to drive a first rotational movement about the axial line upon receipt of fluid from said first guide channel and to drive a second rotational movement opposite to the first rotational movement upon receipt of fluid from said second guide channel;

an output unit installed in said axial hole of said base seat unit, and connected to an end of said cylinder unit along the axial line for outputting the rotation generated by said cylinder unit; and a time-delay unit mounted to said base seat unit, and including a delay switch that is adapted to be fluidly connected to the pneumatic supplier, a flow-limiting valve that is connected downstream of said delay switch, a pressure accumulator that is connected downstream of said flow-limiting valve, and a control valve that is connected downstream of said pressure accumulator and that is fluidly connected to said first retaining space and the pneumatic supplier;

wherein said delay switch is operable to move between an action position and a non-action position, when said delay switch is at the action position, said control valve permitting fluid communication between the pneumatic supplier and said first retaining space therethrough, when said delay switch is moved to the non-action position, said control valve maintaining the fluid communication between the pneumatic supplier and said first retaining space fora period of time and then preventing the fluid communication between the pneumatic supplier and said first retaining space.

2. The pneumatic control device as claimed in claim 1, wherein said base seat unit includes a first base seat, and a second base seat that is connected to an end of said first base seat along the axial line by bolts, said axial hole including a first hole section that is formed in said first base seat and that is defined by an inner surrounding surface of said first base seat surrounding the axial line, and a second hole section that is formed in said second base seat and that is defined by an inner surrounding surface of said second base seat surrounding the axial line, said first base seat further having a drain groove that is formed in said inner surrounding surface, that extends about the axial line and that is in fluid communication with said vent hole, said intake channel, said first retaining space, said second retaining space and said vent hole being formed in said first base seat.

3. The pneumatic control device as claimed in claim 2, wherein said second base seat further has a drain hole that fluidly communicates said second hole section with the external environment.

4. The pneumatic control device as claimed in claim 3, wherein said base seat unit further includes a rear cover that is connected to another end of said first base seat opposite to said second base seat by bolts, said first guide channel including a first guide channel portion that is formed in said first base seat, and a first extending channel portion that is formed in said rear cover and that fluidly communicates said first guide channel portion with said axial hole, said second guide channel including a second guide channel portion that is formed in said first base seat, and a second extending channel portion that is formed in said rear cover and that fluidly communicates said second guide channel portion with said axial hole.

5. The pneumatic control device as claimed in claim 4, wherein said cylinder unit includes a cylinder that is mounted in said axial hole, a rotor that is mounted in said cylinder, and a plurality of angularly spaced-apart vanes that are mounted to said rotor, said cylinder having a cylinder wall that defines a chamber therein, said chamber being eccentric with respect to the axial line, said cylinder wall being formed with a first inlet that is parallel to the axial line and that fluidly communicates said first guide channel with said chamber, a second inlet that is parallel to the axial line and that fluidly communicates said second guide channel with said chamber, and two communication holes that fluidly communicate said vent hole with said chamber, said rotor having an outer surrounding surface that surrounds the axial line, and a plurality of angularly spaced-apart slide grooves that are formed in said outer surrounding surface, said vanes being respectively and slidably mounted in said slide grooves.

6. The pneumatic control device as claimed in claim 5, wherein said rotor further has a connecting axle portion, said output unit including a cage that is co-rotatably connected to said rotor, an output shaft that is mounted to said cage, and at least one hammer that is pivotally connected to said cage for driving rotation of said output shaft, said cage having a coupling hole that is co-rotatably engaged with said connecting axle portion of said rotor, said output shaft having at least one struck portion that corresponds in position to said hammer, said hammer being driven by said rotor via said cage to strike said output shaft so as to drive rotation of said output shaft.

7. The pneumatic control device as claimed in claim 1, further comprising an adjustment unit that is mounted to said base seat unit, and that is fluidly connected between said intake channel and the pneumatic supplier for adjusting flow rate of pressured air flowing into said intake channel.

* * * * *